United States Patent [19]

Mayer et al.

[11] Patent Number: 4,520,432

[45] Date of Patent: May 28, 1985

[54] RECTANGULAR HALOGEN LAMP UNIT AND METHOD OF MANUFACTURE

[75] Inventors: William Mayer; Alton E. Runions, both of Rochester, Ill.

[73] Assignee: Stewart-Warner Corporation, Chicago, Ill.

[21] Appl. No.: 376,619

[22] Filed: May 10, 1982

[51] Int. Cl.[3] ..... F21V 29/00

[52] U.S. Cl. ..... 362/267; 362/61; 362/80; 362/83

[58] Field of Search ..... 362/267, 80, 61, 275, 362/83, 158, 263; 313/221, 318, 323, 25

[56] References Cited

U.S. PATENT DOCUMENTS

| | | | |
|---|---|---|---|
| 4,188,655 | 2/1980 | Tallon | 362/275 |
| 4,210,841 | 7/1980 | Vodicka | 362/267 |
| 4,240,131 | 12/1980 | Albrecht | 362/267 |
| 4,385,257 | 5/1983 | Fitzgerald | 362/267 |

*Primary Examiner*—Donald P. Walsh
*Attorney, Agent, or Firm*—A. G. Douvas

[57] ABSTRACT

A rectangular lamp unit and an integral bracket, replaceable as a unit upon bulb burn-out, including a one-piece plastic reflector closed by a rectangular lens with an integral peripheral mounting flange on the reflector adjacent the lens so that the unit can be mounted substantially flush on a mounting panel. The unit is manufactured by applying an epoxy adhesive to a lens recess in the reflector, joining the lens thereto, and then heating the assembly to cure the epoxy. During heating, evolved gases are released from the reflector through a vent hole that is sealed by a vent plug immediately after heating by inserting the plug coated with a silicone rubber sealant into the vent hole to form a thick seal ring and push sealant into irregularities in the hole. The sealant is cured by residual heat from the epoxy curing step.

10 Claims, 5 Drawing Figures

RECTANGULAR HALOGEN LAMP UNIT AND METHOD OF MANUFACTURE

BACKGROUND OF THE INVENTION

Vitreous glass sealed beam lamp units have been used for vehicle lighting since at least the 1930's in the United States. These lamps generally include a paraboloidal reflector having a highly mirrorized inner surface that usually has two central openings that receive connectors for a filament aligned within the reflector. The reflector is enclosed by a circular convex lens also constructed of glass that is located with respect to the reflector by various types of integral locating tabs and is joined to the reflector by heat fusion. The connector assemblies are also usually connected to the reflector by a heat fusion process, and the composition and pressure of gas within the reflector-lens envelope are carefully controlled through a filling tube formed integrally with the reflector, and this tube is fused after evacuation and/or, inert gas filling of the lamp envelope. Controlling the atmosphere within the evenlope through the filling tube is extremely costly, and the filling tube must be carefully fused at the proper instant to achieve the desired atmosphere within the envelope.

Such a sealed beam lamp unit is shown and described in the D. K. Right U.S Pat. No. 2,148,314 dated Feb. 21, 1939.

These sealed beam lamp units, which must be replaced after the filaments burn out, require complicated locking rings and adjustment assemblies, permanently carried by the associated vehicle to hold them in proper position. The locking rings frequently include adjusting brackets for varying the attitude of the lamp units to properly adjust the lamp's beam to effect the desired lamp alignment.

It has been suggested that the reflector of a rectangular sealed beam lamp unit be constructed of a plastic material with support flanges formed integrally with the plastic to eliminate the complicated mounting flanges and rings required in prior lamp units. Such a construction is shown in the Thomas T. Talon et al U.S. Pat. No. 4,188,655. This patent discloses a lamp with three integral flanges on a plastic reflector that cooperate with three adjusting assemblies mounted to the vehicle that permit adjustment of the lamp beam in two orthogonal planes. While such an arrangement is suitable for many passenger automobile applications it is nevertheless quite costly because of the three separate fastening and adjusting mechanisms required.

The prior manufacture of lamp units has also included the provision of a vent hole in the reflector to permit the escape of gases evolving during the heating steps. One method for sealing this vent hole that has achieved some limited success, is to place a common headed rivet in the vent hole and then backfill the hole with an adhesive material. The rivet serves merely to prevent entry into the lamp envelope by the adhesive material. While this method provides an acceptable seal, the additional cost of the rivet and the labor required for its insertion contribute significantly to the cost of the completed lamp unit.

SUMMARY OF THE PRESENT INVENTION

According to the present invention a rectangular sealed beam halogen lamp unit is provided that is self supporting in the vehicle to which it is attached and does not require any special mounting fixtures. The lamp unit is particularly suitable for heavy duty use in utility vehicles, either on or off the road, and it is designed so that it may be manufactured at a low enough cost to enable the entire unit to be discarded at the time the halogen bulb burns out or fails.

Toward these ends the present rectangular halogen lamp unit includes a one-piece plastic reflector constructed of an impact resistant polyester material with an integral peripheral flange at the foward end thereof that mounts directly to the rim of a rectangular opening in an outer panel of the vehicle. For example, the lamp unit may be a headlamp insertable into a rectangular opening in the forward grill-work of the vehicle. The reflector itself is constructed of a polyester plastic such as "Petlon" manufactured by Mobay Chemical Company. The plastic reflector is generally rectangular and has a highly mirrorized coating on a parabolidal inner surface that reflects light from a halogen bulb through a rectangular lens constructed of either plastic or vitreous glass material. The lens, rather than being fused to the reflector as in vitreous glass sealed beam lamps, is joined to the rectangular reflector by an adhesive in a forwardly opening rectangular recess in the reflector.

During manufacture, the halogen bulb assembly is positioned within the reflector and external terminals are connected. Then epoxy adhesive is applied to the forwardly opening lens recess in the reflector, and the lens is inserted in the recess. The reflector and lens assembly is then baked in an oven at a temperature and for a time sufficient to cure the epoxy material and permanently bond the lens to the reflector. The heating times and temperatures required to cure the epoxy adhesive for the lens do not alter the position of the halogen bulb in the reflector nor cause distortion of the mirrorized reflector paraboloidal surface, and thus the significant distortion problems that occur during the manufacture of vitreous sealed beam lamp units do not occur in this new method. This elimination of distortion is a very important advantage because distortion changes the optical alignment of the lamp.

As the lens adhesive is being heat cured, gases are produced and are permitted to escape from the reflector envelope through a vent hole in the back of the reflector adjacent to the halogen bulb terminals. After the reflector and lens assembly is removed from the oven or furnace when adhesive curing is completed, the vent hole is sealed with a plug. The plug is constructed of the same polyester material as the reflector to assure both have the same coefficient of thermal expansion. This vent hole plug has a tapered forward portion to assist in guiding the plug into the hole, and a rear cylindrical portion that has a diameter 4 to 6 thousanths of an inch (0.004 to 0.006 inches) larger than the diameter of the vent hole to assure mating and sealing contact with the reflector vent hole. This plug also has an enlarged cup shaped head that has an annular recess facing toward the vent hole. Prior to insertion into the vent hole, the plug is dipped into a liquid silicone rubber sealant, wetting the entire outer surface of the cylindrical portion and the tapered portion of the plug and also filling the annular recess.

The wetted plug is inserted into the vent hole immediately after the heat curing of the epoxy lens adhesive so that the residual heat in the reflector-lens assembly will cure the silicone rubber sealant between the vent plug and the vent hole in the reflector.

The use of residual heat in the lamp unit after epoxy curing to cure the silicone sealant between the vent plug and the vent hole eliminates any requirement for a separate heat curing step for the sealant and expedites the manufacturing process.

The epoxy material in the annular recess in the head performs a two-fold function. Firstly, it forms a heavy sealing ring around the outer periphery of the vent hole. Secondly, the vent hole itself is usually machined after the molding of the reflector to eliminate the necessity for complicated pin removal from the mold and this machining frequently results in somewhat out of round vent holes as will be appreciated by those familiar with plastic machining operations. In cases where the vent hole is somewhat out of round, some of the silicone sealant in the head recess will flow into any voids between the cylindrical portion of the plug and the vent hole assuring a complete seal.

The integral peripheral flange extending around the forward portion of the reflector enables the lamp unit to be mounted to the rim or edge portion of a rectangular opening in a vehicle panel without requiring any separate connecting brackets. When the lamp unit is replaced with a new lamp unit the only fasteners required are four simple threaded fasteners extending through four apertures in the mounting flange and the vehicle panel. Not only does this design eliminate the necessity for any mounting brackets it also eliminates the requirement that the mounting brackets themselves be replaced because of failure or excessive corrosion. This integral mounting flange eliminates the necessity for peripheral retainers required in vitreous seal beam lamp units, and even provides a limited shock absorbing function because of the inherent shock resistant characteristics of the integral plastic mounting flange and reflector.

DETAILED DESCRIPTION OF THE PREFERRED EMBODIMENT

Figure 1:
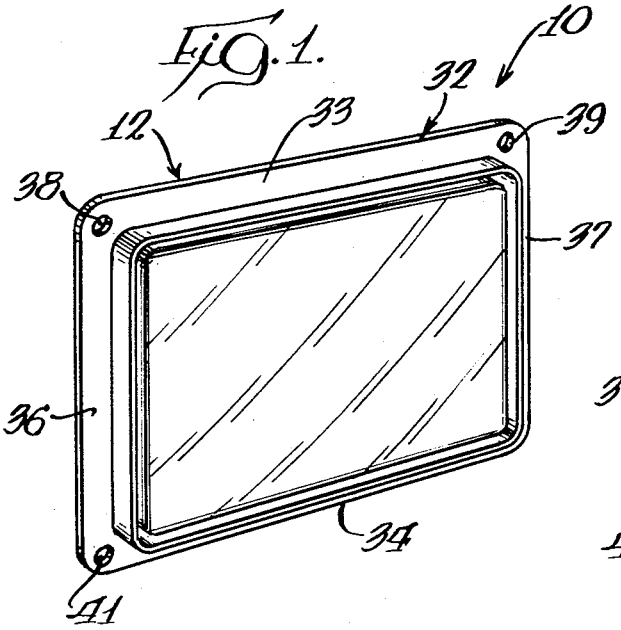
FIG. 1 is a perspective view of a rectangular sealed beam lamp unit according to the present invention.
Figure 2:
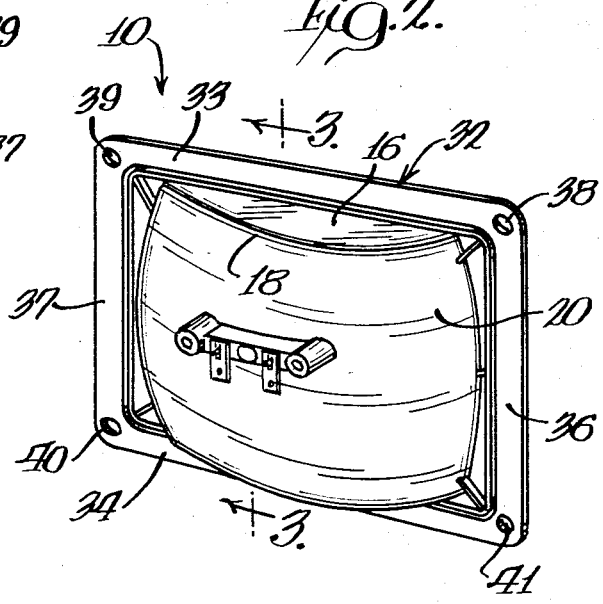
FIG. 2 is a rear perspective view of the rectangular lamp illustrated in FIG. 1.
Figure 3:
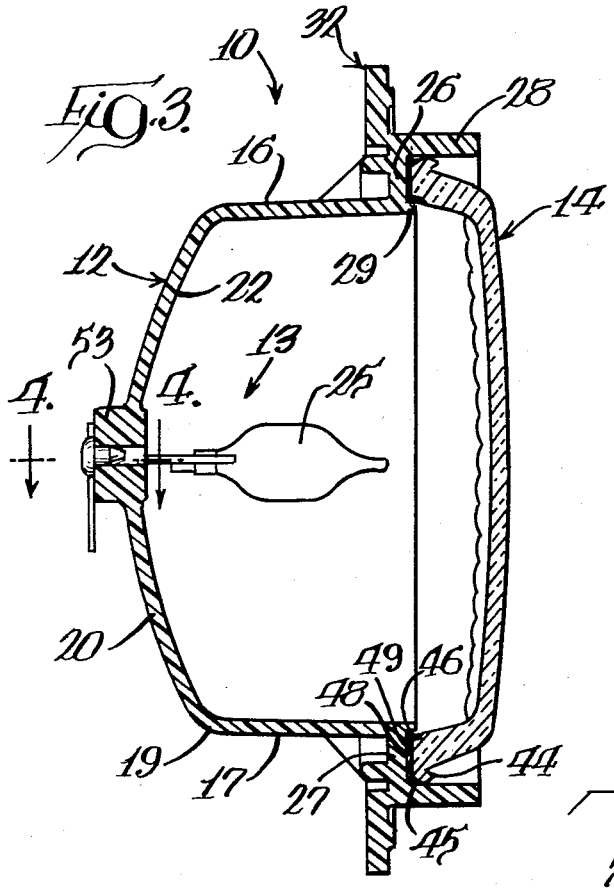
FIG. 3 is a cross-section taken generally along line 3—3 of FIG. 2 illustrating the mounting flange integral with the reflector and the lens position in the reflector.

Referring to the drawings and particularly FIGS. 1 to 3, a rectangular sealed beam halogen headlamp unit 10 is illustrated generally including a one-piece plastic reflector 12 with a halogen bulb assembly 13 mounted therein enclosed by a vitreous glass or plastic rectangular lens 14.

An important aspect of the present invention is that the reflector 12 is constructed entirely of a one-piece plastic molding of an impact resistant plastic. One plastic that has been found particulary suitable is a polyester plastic "Petlon" manufactured by Mobay Chemical Company. This plastic is durable, shock resistant and it also withstands a broad range of temperature variations.

The plastic reflector 12 includes generally flat top and bottom walls 16 and 17 having arcuate rear ends 18 and 19 connected together by a central paraboloidal wall 20. Interior surface 22 of walls 16, 17 and 20 are mirrorized by metallic vacuum deposition or other suitable process to provide the necessary reflective characteristics for the interior of the reflector to direct and focus light, emitting from a halogen bulb 25 in bulb assembly 13, forwardly from the lamp unit through the geometric axis of the lamp unit through lens 14.

The forward end of the reflector 12 has a rectangular forwardly opening lens receiving recess 26 that is defined by outwardly extending integral wall 27, forwardly extending integral wall 28, and a forwardly extending rim 29 from the walls 16, 17 and 20. The walls 27, 28 and rim 29 extend peripherally completely around the reflector 12. The wall 28 serves not only to define in part recess 26 but also forms a hood or shield around lens 14 to protect the lens and to limit stray light emission from the lamp unit in a direction perpendicular to the axis of the unit.

The lens 14 may be constructed of vitreous glass or plastic, either transparent or translucent and is seen to have an outer peripheral rim 44 having a beveled rear surface 45 and an inner corner recess 46 that fits over and seals against the end of projecting rim 29. The position of recess 46 locates rear surface 48 of the reflector spaced slightly from the bottom surface of recess 26 to form a pocket with the beveled wall 45 in the recess for an epoxy adhesive 49 that extends all around in the recess 26.

A mounting flange 32 is formed integrally with walls 27 and 28 and includes straight parallel top and bottom portions 33 and 34 interconnected by straight parallel side portions 36 and 37 as seen clearly in FIG. 1. The mount flange 32 has molded apertures 38, 39, 40 and 41 that receive conventional threaded fasteners for holding the entire lamp unit 10 to an outer panel in the vehicle to which it is attached.

During manufacture, the halogen bulb assembly 13 is positioned and aligned within the reflector 12 and the epoxy adhesive 49 is applied to reflector recess 26. Thereafter lens 14 is pressed into the recess 26 and the assembly is placed in an oven or furnace for a time and temperature, usually around 320 degrees Fahrenheit, sufficient for curing the epoxy material 49 and permanently bonding the lens 14 to the reflector 12. During this heat curing of the epoxy adhesive, gases evolving from the curing polymerization process escape from the reflector envelope through a cylindrical vent hole 52 that extends centrally through a boss 53 positioned centrally in the wall 20 of the reflector. The vent hole 52 is formed in the reflector 12 subsequent to molding the reflector to eliminate the requirement for a core pin for the hole. Vent hole 52 is open throughout this curing process, but after curing the vent hole 52 is closed by a vent hole plug 55. Vent hole plug 55 is constructed of the same plastic material as the reflector 12, namely a polyester material such as "Petlon", so that the vent hole plug 55 has the same coefficient thermal expansion as the reflector 16 to improve the sealing of the vent hole 52.

Figure 4:
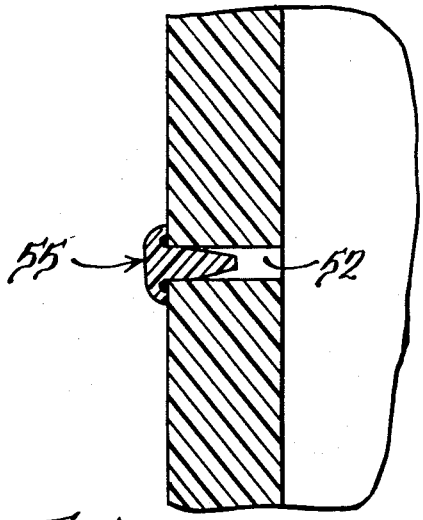
FIG. 4 is an enlarged fragmentary view taken generally along line 4—4 of FIG. 3 illustrating the reflector vent hole.
Figure 5:
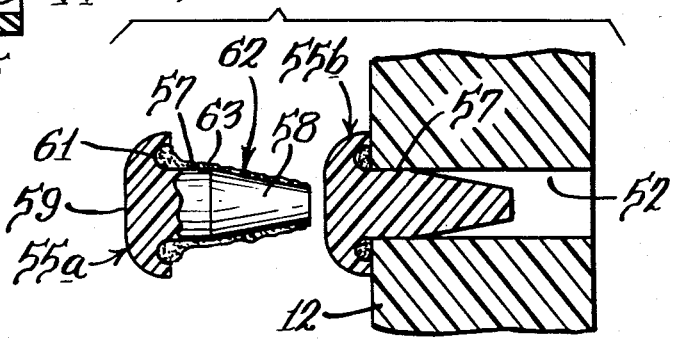
FIG. 5 is an exploded view of the vent hole plug prior to and after positioning within the reflector vent hole.

The vent hole plug 55 completes the sealing of the interior envelope of the lamp unit 10 and as seen in FIGS. 4 and 5 includes a cylindrical upper shank portion 57 and a frusto-conical tapered forward end 58. The shank portion 57 carries an integral head 59 that is cup shaped in configuration and has a semi-toroidal recess 61 in its forward surface 62.

The cylindrical shank portion 57 has an outer diameter slightly larger than the diameter of cylindrical vent hole 52 to provide an interference fit therewith when positioned within the vent hole. For example, the vent hole may have a diameter of 0.082 inches and the shank portion 57 a diameter of 0.086 inches yielding a 0.004 inch inteference between the parts. This provides excellent surface to surface contact sealing by the plug 55.

Prior to insertion of the plug 55 in the vent hole 52 the plug 55 is dipped into a silicone rubber sealant 62, such as "Sylastic", so that sealant wets the entire periphery of portions 57 and 58 as well as fills the semi-teroidal recess 61.

Immediately after the lamp unit is removed from the curing oven for epoxy 49, the wetted plug illustrated at 55*a* of FIG. 5 is inserted and pressed into the vent hole 52 and driven to its flush position illlustrated at 55*b* in FIG. 5 with forward surface 63 on the head of the vent plug in engagement with the outer surface of the reflector. The cylindrical shank portion 57 continues to be wetted with the silicone sealant and the large cross-section of sealant in recess 61 in engagement with the rear surface of the reflector provides an exceptionally thick and strong annular ring seal for the vent hole. Moreover, the machining of hole 52, by drilling for example, frequently results in irregular or oval shaped cross-sections in the hole that are somewhat difficult to seal. In the event that the vent hole 52 is irregularly shaped and does not have full peripheral contact with shank portion 57, the silicone in recess 61 will be forced into any voids between the vent hole and the plug shank as the plug is driven to its fully seated position illustrated at 55*b* in FIG. 5.

As noted above, the plug 55 is inserted into the vent hole 52 immediately after the lamp unit is withdrawn from the epoxy curing oven at which time it is at a temperature between 250 and 325 degrees Fahrenheit. The stored heat in the reflector 12 and lens 14 at this time is sufficient to completely cure the silicone sealant 62 without the application of any further heat and considerably simplifies the final sealing of the reflector. A suitable primer may be applied to the vent hole 52 and the plug 55 prior to the application of the liquid silicone.

We claim:

1. A method of making a rectangular sealed beam lamp unit having a paraboloidal plastic reflector with a sealed vent hole therein with a generally rectangular lens enclosing the reflector, including the steps of applying an adhesive to either of the mating surfaces of the reflector and lens, pressing the lens into engagement with the reflector, heating the resulting reflector-lens assembly with the vent hole open for a predetermined time and a predetermined temperature sufficient to create a bond between the adhesive and the lens and reflector permitting evolved gases to escape through the vent hole, applying a heat curable adhesive seal material to a vent hole plug, and inserting the vent hole plug in the vent hole in the reflector immediately after the heating of the reflector while the reflector is still at an elevated temperature so that the residual heat in the reflector from the heating step cures the vent hole plug seal material.

2. A method of making a rectangular sealed beam lamp unit having a paraboloidal plastic reflector with a sealed vent hole therein with a generally rectangular lens enclosing the reflector, as defined in claim 1, wherein the vent hole plug has an enlarged head with a recess therein opening toward the vent hole in the reflector when assembled, wherein the step of applying a heat curable seal material to the vent hole plug includes applying at least a portion of the heat curable seal material into the recess in the head of the vent hole plug, and wherein the step of inserting the vent hole plug into the vent hole includes pressing the vent hole plug head during insertion of the plug to force seal material in the recess into any irregularities between the vent hole plug and the vent hole.

3. A method of making a rectangular sealed beam lamp unit having a paraboloidal plastic reflector with a sealed vent hole therein with a generally rectangular lens enclosing the reflector, as defined in claim 1, including the step of forming the vent hole in the reflector by machining after the reflector is molded, and forming the vent hole plug with a taper to assist in guiding the vent hole plug into the vent hole.

4. A method of making a rectangular sealed beam lamp unit having a paraboloidal plastic reflector with a sealed vent hole therein with a generally rectangular lens enclosing the reflector, as defined in claim 1, including the step of forming the reflector with a plastic paraboloidal reflector portion having an optical axis and a lens receiving recess forwardly of the reflector portion, and the step of forming the reflector with an integral plastic mounting flange that is positioned adjacent the lens receiving recess and extends outwardly in a direction perpendicular to the optical axis so that the lamp unit may be mounted in a panel without projecting significantly forwardly therefrom.

5. A method of making a rectangular sealed beam lamp unit having a paraboloidal plastic reflector with a rectangular lens sealed to the reflector, including the steps of; forming the reflector with a vent hole to permit the release of gases during subsequent heating steps forming a vent hole plug with an enlarged head portion engageable with an outer surface of the reflector around the vent hole with a recess therein and a cylindrical shank portion having an outer diameter substantially equal to the diameter of the vent hole, said head portion recess facing the reflector outer surface and the plug shank portion, applying an adhesive to the lens or reflector and joining the two together with the application of heat, applying an adhesive seal material to the vent hold plug shank portion and at least partly into the head recess, and after the release of gases through the vent hole, inserting the vent hole plug into the vent hole to form a seal between the plug and the reflector.

6. A method of manufacturing a rectangular sealed beam lamp unit with a plastic paraboloidal reflector and a rectangular lens sealed to the reflector, as defined in claim 5, wherein the step of inserting the vent hole plug in the vent hole occurs immediately after the application of heat to join the lens and the reflector so that only the residual heat is used to cure the vent hole seal material.

7. A method of manufacturing a rectangular sealed beam lamp unit with a plastic paraboloidal reflector and a rectangular lens sealed to the reflector as defined in claim 5, where the step of forming the vent hole plug includes forming the vent hole plug enlarged head portion with a semi-toroidal recess therein facing the rear surface of the reflector adjacent the outside of the vent hole when assembled, and wherein the step of inserting the plug includes pressing the head portion during insertion of the plug against the outside of the reflector to force seal material into irregularities, if any, in the vent hole.

8. A method of manufacturing a rectangular sealed beam lamp unit with a plastic paraboloidal reflector and a rectangular lens sealed to the reflector, as defined in claim 5, including the step of forming the vent hole in the reflector after molding the reflector as a substantially straight cylindrical hole, and forming the vent hole plug with a taper to assist in inserting the plug into the hole and a cylindrical shank portion that has a sufficient diameter to interfere with the vent hole.

9. A method of manufacturing a rectangular sealed beam lamp unit with a plastic paraboloidal reflector and a rectangular lens sealed to the reflector, as defined in claim 5, including the step of forming the reflector with a plastic paraboloidal reflector portion having an optical axis and a lens receiving recess positioned forwardly of the reflector portion, and the step of forming the reflector with integral plastic mounting flange that is positioned adjacent the lens receiving recess and extends outwardly in a direction perpendicular to the optical axis so that the lamp unit can be mounted in a panel without projecting significantly forwardly therefrom.

10. A rectangular sealed beam lamp unit, comprising; a generally rectangular plastic reflector body with a paraboloidal interior reflective surface, a generally rectangular lens sealed to the front of the reflector body with a heat curable adhesive, said body having a vent hole therethrough that is open during heat curing to permit the escape of gases evolving during heat curing, a vent hole plug for sealing the vent hole after gases have escaped, said vent hole plug having an enlarged head with an annular recess facing the reflector body and forming therewith an annular pocket and having a stem portion extending into the vent hole, and a seal material in the head recess and around the stem portion.

* * * * *